United States Patent [19]

Wright et al.

[11] 4,147,076

[45] Apr. 3, 1979

[54] REVERSING-RATCHET SOCKET WRENCH

[75] Inventors: Richard B. Wright, Akron; Ronald D. Konieczynski, North Royalton, both of Ohio

[73] Assignee: The Wright Tool and Forge Company, Barberton, Ohio

[21] Appl. No.: 847,153

[22] Filed: Oct. 31, 1977

[51] Int. Cl.[2] ..... B25B 13/46

[52] U.S. Cl. ..... 81/63.2; 192/43.1

[58] Field of Search ..... 81/63, 63.2; 192/43.1

[56] References Cited

U.S. PATENT DOCUMENTS

| | | | |
|---|---|---|---|
| 1,195,294 | 8/1916 | Trubey | 81/63.2 |
| 2,188,846 | 1/1940 | Rueb | 192/43.1 |
| 3,233,481 | 2/1966 | Bacon | 81/63 |

*Primary Examiner*—James L. Jones, Jr.

*Attorney, Agent, or Firm*—Bosworth, Sessions & McCoy

[57] ABSTRACT

A reversing-ratchet wrench for use, for example, with various interchangeable socket heads. One end of the wrench serves as a handle and the fulcrum end has an opening that defines internal ratchet teeth and that receives a pawl carrier rotatable about the axis of turn of the wrench. The ratchet teeth are engaged by a double pawl pivotally mounted in a lateral slot cut in the side of the pawl carrier, the pawl being urged to either a forward drive or reverse drive position of engagement with the ratchet teeth by a selector mechanism. The selector mechanism includes a hub received in a central bore in the pawl carrier and a pivotal selector button on the upper end of the hub. The lower end of the hub has a lateral opening that receives a spring-loaded pawl-operating plunger. The plunger has a length greater than the depth of the lateral opening and extends into the slot in the pawl carrier to resiliently engage the double pawl and also to secure the selector mechanism in the pawl carrier.

1 Claim, 7 Drawing Figures

REVERSING-RATCHET SOCKET WRENCH

BACKGROUND OF THE INVENTION

This invention relates to hand tools for turning threaded connectors, such as machine screws, bolts and nuts, and especially to wrenches with a reversing ratchet-and-pawl mechanism. More particularly, the invention relates to a reversing-ratchet wrench for various interchangeable socket heads with an improved forward-reverse selector mechanism that simplifies assembly and facilitates the retaining of the selector mechanism in the pawl carrier.

Wrenches with reversing-ratchet drive are well-known in the art and are commonly used as socket tools. The inner end, or fulcrum end, of the wrench, usually has a male-type connector, or stud, that fits in a square female recess in various interchangeable socket heads with which the wrench is to be used. Wrenches of this general construction are disclosed in U.S. Pat. Nos. 3,393,587 and 3,881,376.

In wrenches of this type, internal ratchet teeth are generally formed in an opening in the fulcrum end of the wrench and a cylindrical pawl carrier with a square drive stud on one end is mounted in the opening for rotation about the axis of turn on the wrench. The pawl carrier also has a central axial bore in the end opposite the drive stud and a lateral slot cut in one side perpendicular to the axis of the pawl carrier and extending to the axial bore. A double pawl is pivotally mounted within the slot and is adapted for selective driving engagement with the internal ratchet teeth. The pawl is pivotally connected by a pivot pin that extends therethrough parallel to the axis of turn and that has its opposite ends journaled in the pawl carrier.

A ratchet drive selector mechanism is used to control the position of the double pawl to provide either forward or reverse ratchet drive. The selector mechanism has a hub that is pivotally mounted in the axial bore in the pawl carrier and the hub has a transverse bore that extends partly therethrough and is adapted to receive a plunger with a length less than the depth of the bore. The plunger is biased to an extended position by a helical spring that urges the plunger radially outward into the lateral slot and against the double pawl.

In the assembly of prior art socket wrenches of the type described, the plunger and spring are pressed into the transverse bore in the hub until the plunger is entirely within the bore. Then the hub is inserted in the central axial bore in the pawl carrier until the transverse bore in the hub registers with the lateral slot. At this point, the plunger is released to extend radially outward into the lateral slot and into engagement with the pawl to urge the pawl into either its forward drive or reverse drive condition, depending upon the position to which the selector mechanism is turned. It will be noted that in prior art wrenches of this type, the pawl must first be mounted in the pawl carrier before the selector mechanism and pawl carrier are assembled together. One problem with this type of construction is the certain difficulties occur during machining and assembly that consequently require a time-consuming procedure on the part of the assembler.

The reversing-ratchet socket wrench design of the present invention, however, reduces the difficulties indicated above and affords other features and advantages heretofore not obtainable.

SUMMARY OF THE INVENTION

It is among the objects of the invention to simplify the assembly of reversing-ratchet wrenches.

Another object is to provide an improved selector mechanism for selecting the reverse drive, or forward drive, conditions for a double pawl in the ratchet and pawl device of a reversing-ratchet wrench.

These and other objects and advantages are achieved with the novel socket wrench construction of the invention. The basic components of a wrench embodying the invention include a lever with an opening in the fulcrum end that defines internal ratchet teeth about the axis of turn. A generally cylindrical pawl carrier is mounted in the opening for rotation relative to the lever about the axis of turn of the pawl carrier, the pawl carrier also having a central axial bore and a laterally extending slot cut in the side facing the ratchet teeth perpendicular to the axis of turn and communicating with the bore. A double pawl is mounted in the slot for pivotal movement about the pivot axis parallel to and spaced from the axis of turn, between forward drive and reverse drive engagement with the ratchet teeth.

In accordance with the invention, a novel pivotal selector mechanism is received in the pawl carrier for pivotal movement about the axis of turn to switch the double pawl between its forward drive and reverse drive engagement with the ratchet teeth and also for retaining itself in position in the pawl carrier. The selector mechanism includes a central hub received in the central bore and having a transverse opening at the lower end thereof. A selector button is located on the upper end of the hub and a pawl-operating plunger is slideably received in the transverse opening and in accordance with the invention has a length greater than the depth of the transverse opening. The plunger extends into the lateral slot and is engageable with the double pawl to pivot the pawl in response to manual switching of the selector mechanism between forward drive and reverse drive engagement with the ratchet teeth. The plunger is slideable in the opening between an extended position and a retracted position to permit ratcheting of the wrench, however, in its retracted position the forward end of the plunger still protrudes into the slot to prevent the hub from sliding out of the central bore and thus to lock the selector mechanism in position. A spring means is also provided for urging the plunger toward its extended position. In the preferred embodiment, the lateral opening extends entirely through the hub portion and the spring is a helical spring positioned around a smaller diameter inner end portion of the plunger.

DESCRIPTION OF THE PREFERRED EMBODIMENT

Figure 1:
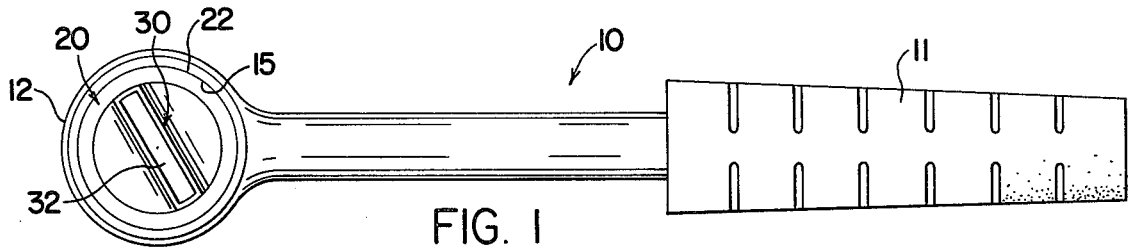
FIG. 1 is a plan view of a reversing-ratchet socket wrench embodying the invention.
Figure 2:
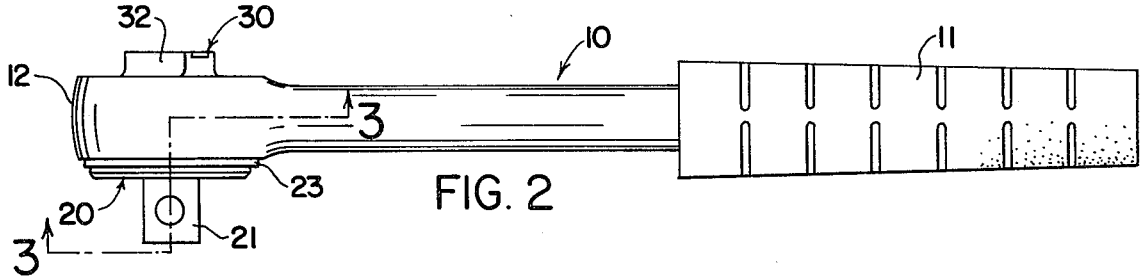
FIG. 2 is a side elevation of the reversing-ratchet socket wrench of FIG. 1.
Figure 3:
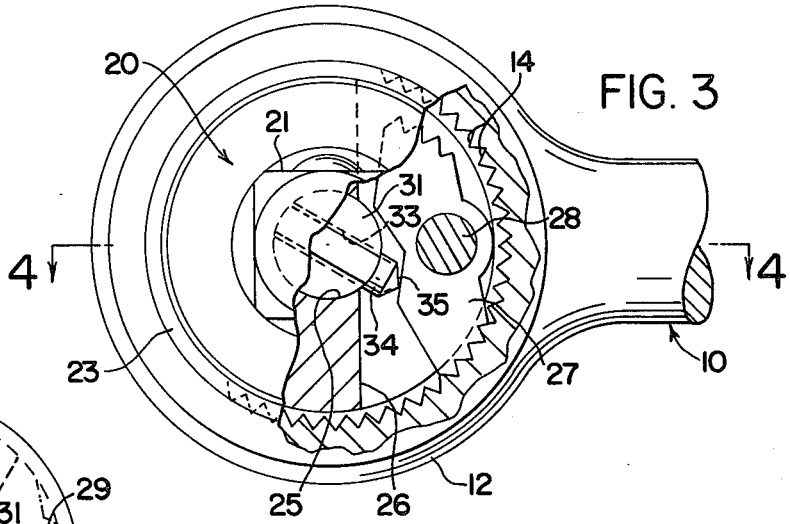
FIG. 3 is a fragmentary sectional view on an enlarged scale taken on the line 3—3 of FIG. 2 with parts broken away for the purpose of illustration.
Figure 5:
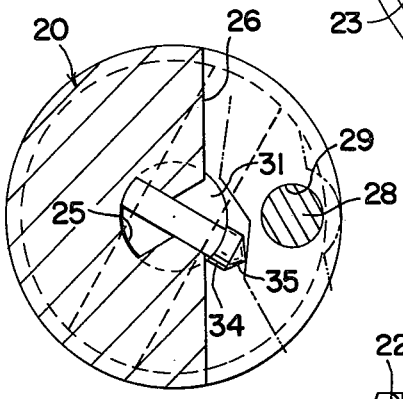
FIG. 5 is a fragmentary sectional view taken on the line 5—5 of FIG. 4.

Referring more particularly to the drawings, and initially to FIGS. 1–4, there is shown a reversing-ratchet-type socket wrench embodying the invention and adapted to drive one of several interchangeable socket heads of standard construction. The wrench comprises a lever 10 when a handle 11 at one end and having at the fulcrum end 12 a circular opening 13 about the axis of turn. The opening 13 is provided with internal ratchet teeth 14 and also has on the upper side, as viewed in FIGS. 2 and 4, a smooth counterbore 15.

Rotatably mounted within the opening 13 is a pawl carrier 20 having a male square 21, or stud, extending downwardly and adapted to fit in a mating female recess in socket head. The pawl carrier 20 has an annular shoulder 22 that seats in the counterbore 15, and the pawl carrier is retained in position in the fulcrum portion 12 by means of annular lock rings 23 seated in an annular groove 24 in the lower end of pawl carrier 20.

The pawl carrier 20 has an axial bore 25 (FIGS. 3–6) formed therein and a lateral slot 26 cut perpendicular to the axis of the pawl carrier 20 and extending to the axial bore 25. Pivotally mounted within the slot 26 is a double pawl element 27 with its teeth at the opposite ends thereof adapted for selective driving engagement with the ratchet teeth 14 of the fulcrum end 12. The pawl 27 is pivotally connected to the pawl carrier within the slot 26 by a pawl pivot pin 28 extending therethrough and having its opposite ends received in opposite ends of a bore 29 extending through the pawl carrier 20 in a axial direction parallel to the axis of turn.

Figure 6:
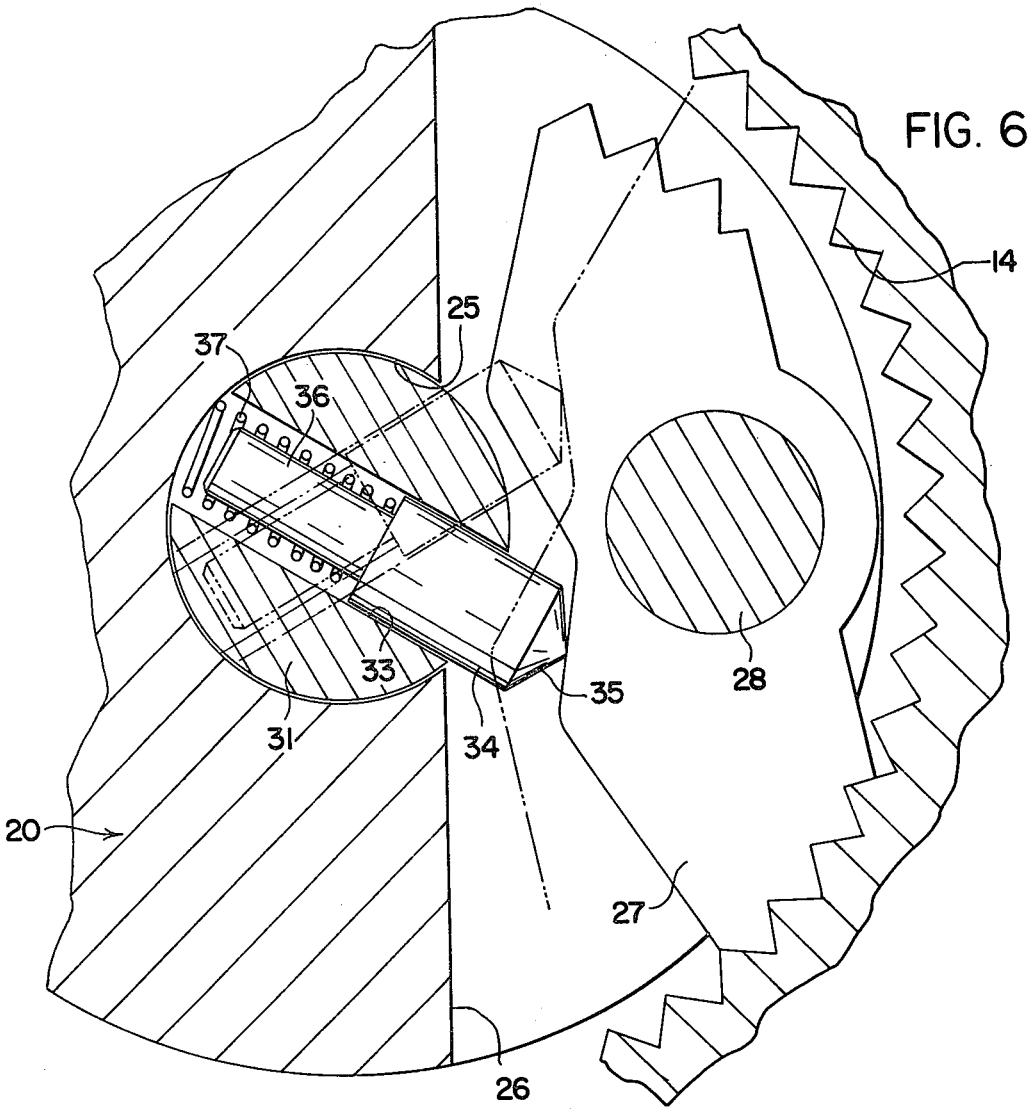
FIG. 6 is a fragmentary sectional view on a greatly enlarged scale illustrating the engagement between the selector mechanism plunger and the double pawl.
Figure 7:
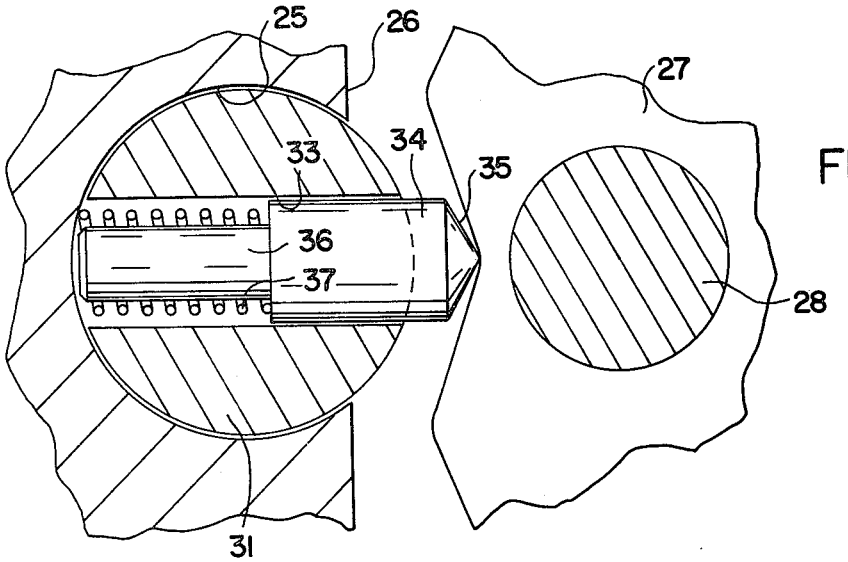
FIG. 7 is another fragmentary sectional view on a greatly enlarged scale illustrating the neutral position of the pawl-operating plunger.

Referring to FIG. 6, it will be seen that the double pawl element 27 is capable of limited pivotal movement between a forward drive position illustrated in solid lines in FIG. 6, wherein the handle 11 drives a socket when turned clockwise and ratchets when turned counterclockwise; and a reverse drive position illustrated in dashed lines in FIG. 6 wherein the handle 11 drives the socket when turned counterclockwise and ratchets when turned clockwise.

A ratchet drive selector mechanism 30 is used with associated parts to control the position of the double pawl element 27 to provide either forward or reverse drive. The mechanism 30 has a cylindrical hub portion 31 extending into the axial bore 25 in the pawl carrier 20 and has a rotary selector button 32 on the upper end of the hub portion 31, as viewed in FIGS. 2 and 4, the selector button 32 being adapted for engagement by the fingers of an operator for pivotal movement between forward drive, or reverse drive, conditions. The lower end of the hub portion 31 has a transverse opening 33 extending therethrough and which slideably receives a pawl-operating plunger 34 with a length that is greater than the length of the transverse bore, or, in other words, greater than the diameter of the hub portion 31. The plunger has a tip 35 at its forward end that extends into slot 26 and engages the double pawl element 27 as indicated in FIGS. 3, 5, 6 and 7. The bottom face of the hub portion 31 has a protruding transverse ridge (FIG. 5) located in a flared-end slot in the bottom of the axial bore 25 to limit the pivotal movement of the selector mechanism 30.

The plunger 34 is of generally cylindrical form with a diameter that essentially matches the diameter of the transverse bore 33. The rearward end portion 36 of the plunger, however, is turned to a reduced diameter and is adapted to receive therearound a helical spring 37 which can be compressed on the rearward end to the condition shown in FIG. 7, and which bears between the main body of the plunger and the wall of the central bore 25.

The selector button 32 rests against the top surface of the pawl carrier 20 and may be turned within limits of about 60° of pivotal movement to turn the hub portion between the position shown in solid lines in FIG. 6 and the position shown in dashed lines in FIG. 6.

Figure 4:
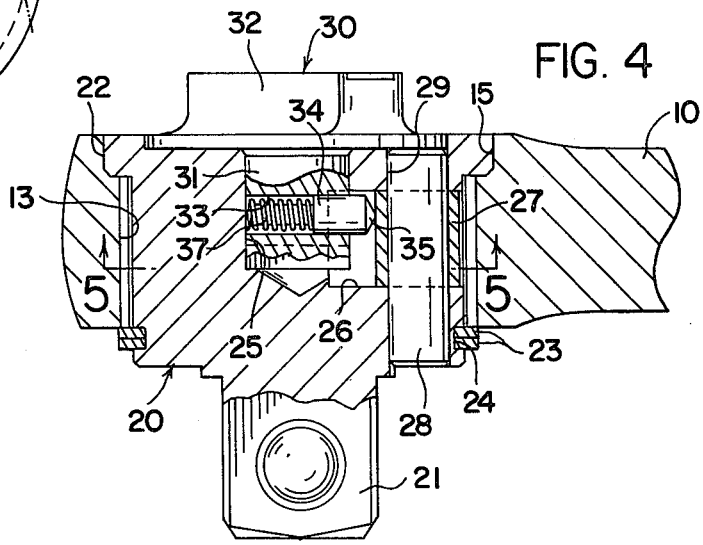
FIG. 4 is a fragmentary sectional view with parts broken away taken on the line 4—4 of FIG. 3.

Because the length of the plunger 34 is greater than the length of the transverse bore 33, the plunger 34, in its assembled condition, serves to lock the ratchet drive selector mechanism 30 onto the pawl carrier 20, as will be most apparent from FIG. 4. FIG. 6 shows the plunger 34 retracted almost to its innermost position, whereat the rearward end thereof engages the wall of the axial bore 25 in the pawl carrier 20. On the other hand, extension of the plunger from the transverse bore 33 is limited by the pawl 27 which is retained in the slot 26 by the pawl pivot pin 28.

As a consequence of this construction, the prior art method of assembly as described above need not be utilized. The prior art method comprised first placing a plunger in a blind bore in the hub of the ratchet drive selector mechanism and then inserting the hub portion into the central axial bore 25 in the pawl carrier. The plungers utilized in the prior art were, of course, of an axial length less than the depth of the blind bore in the hub portion.

In accordance with the present invention, the assembly of the ratchet drive selector element with the pawl carrier 20 is accomplished by first placing the hub portion 31 of the ratchet drive selector mechanism 30 in the central axial bore 25 and then pushing it downward until the transverse bore 33 registers with the slot 26. Then the plunger 34 with the helical spring 37 mounted thereon is inserted in the transverse bore 33 using the double pawl element 27 to force it to a condition with the helical spring slightly compressed. After this is accomplished, the pawl pivot pin is inserted into the bore 29 and through the matching opening in the pawl 27 until the upper end of the pin 28 as viewed in FIG. 4 comes to rest against the inner surface of the selector button 32.

The assembled pawl carrier and ratchet drive selector element 30 are then placed in the fulcrum end 12 of the lever 10 and locked into position using the lock rings 23. This completes the assembly of the wrench and avoids the difficulties described above.

A particular advantage of the improved wrench construction of the invention as described above is that the plunger 34 has a longer life than do the types of plungers used in the prior art. This results from the relatively large area of the cylindrical surface of the plunger that engages the interior surface of the transverse opening 33 during sliding movement of the plunger 34 in the opening 33 when the selector button 31 is switched from one position to another (for comparison, see, e.g., U.S. Pat. Nos. 3,393,587 and 3,881,376 referred to above). This feature also reduces the tendency of the plunger 34 to cock as the transverse opening 33 enlarges with wear.

While the invention has been shown and described with respect to specific embodiments thereof, this is intended for the purpose of illustration, rather than limitation, and other variations and modifications of the specific device herein shown and described will be apparent to those skilled in the art, all within the intended spirit and scope of the invention. Accordingly, the patent is not to be limited in scope and effect to the specific embodiment herein shown and described, nor in any other way that is inconsistent with the extent to which the progress in the art has been advanced by the invention.

We claim:

1. In a reversing-ratchet socket wrench including a lever with a handle at one end and a circular opening in the other end defining internal ratchet teeth about the axis of turn of said wrench, a generally cylindrical pawl carrier received in said circular opening for rotation relative to said lever about said axis of turn of said wrench, said pawl carrier also having a central axis bore and a laterally extending slot cut in the side thereof facing said ratchet teeth and communicating with said bore and a double pawl mounted in said slot for pivotal movement about a pivot axis parallel to and spaced from said axis of turn between forward and reverse drive engagement with said ratchet teeth, the improvement which comprises:

a pivotable selector means received in said pawl carrier for pivotal movement about said axis of turn, for switching said double pawl element between its forward drive and reverse drive engagement with said ratchet teeth said selector means including:

a central hub portion received in said central bore and having a transverse opening at the lower end thereof, said opening being open at one end and communicating with said slot, and being closed at the other end by the interior surface of said bore, a rotary selector button on the upper end of said hub portion, a pawl-operating plunger slidably received in said transverse opening, and having a length greater than the depth of said transverse opening, and thus greater than the diameter of said central bore so that interference between said plunger and the side of said bore keeps the forward end of said plunger extending beyond the diameter of said bore into said slot to lock said selector means in said bore, said plunger having an enlarged forward portion with a diameter approximately equal to the diameter of said transverse opening and a rearward portion of smaller diameter being engageable with said double pawl for pivoting said pawl in response to manual switching of said selector means between said forward drive and reverse drive engagement with said ratchet teeth, said plunger being slidable in said opening between an extended position and a retracted position to permit ratcheting of said wrench, and a helical spring located in said transverse opening surrounding said rearward portion of said plunger and bearing between the interior surface of said bore and said forward portion of said plunger to urge said plunger toward said extended position.

* * * * *